US011918887B2

(12) United States Patent
Shigeta

(10) Patent No.: US 11,918,887 B2
(45) **Date of Patent: *Mar. 5, 2024**

(54) CARD GAME SYSTEM AND METHOD OF A TABLE GAME

(71) Applicant: ANGEL GROUP CO., LTD., Shiga (JP)

(72) Inventor: Yasushi Shigeta, Shiga (JP)

(73) Assignee: ANGEL GROUP CO., LTD., Shiga (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/923,779

(22) Filed: Jul. 8, 2020

(65) Prior Publication Data

US 2020/0338434 A1 Oct. 29, 2020

Related U.S. Application Data

(63) Continuation of application No. 15/794,452, filed on Oct. 26, 2017, now Pat. No. 10,744,397, which is a (Continued)

(30) Foreign Application Priority Data

Apr. 12, 2013 (AU) ..... 2013204282

(51) Int. Cl.

| | |
|---|---|
| ***A63F 1/00*** | (2006.01) |
| ***A63F 1/14*** | (2006.01) |
| ***A63F 1/18*** | (2006.01) |

(52) U.S. Cl.

CPC ..... *A63F 1/00* (2013.01); *A63F 1/14* (2013.01); *A63F 1/18* (2013.01); *A63F 2001/001* (2013.01)

(58) Field of Classification Search

CPC ..... A63F 1/00; A63F 1/14; A63F 1/18; A63F 2001/001

See application file for complete search history.

(56) References Cited

U.S. PATENT DOCUMENTS

| | | | |
|---|---|---|---|
| 4,750,743 | A | 6/1988 | Nicoletti |
| 5,019,973 | A | 5/1991 | Wilcox et al. |

(Continued)

FOREIGN PATENT DOCUMENTS

| | | | |
|---|---|---|---|
| AU | 2011303293 | B2 | 3/2012 |
| AU | 2013200120 | A1 | 1/2013 |

(Continued)

OTHER PUBLICATIONS

NZ Patent Application No. 730115, Office Action dated Oct. 24, 2018.

(Continued)

*Primary Examiner* — Kevin Y Kim
(74) *Attorney, Agent, or Firm* — NORTON ROSE FULBRIGHT US LLP

(57) ABSTRACT

A table game system capable of providing a table game to provide a chance to bet more higher paid off odds and additional wagering opportunities during the play in a way that is not complicated is provided. The set of shuffled decks of playing cards has a different card arrangement orders due to shuffling, and thus, each set is unique. Therefore, in order to identify each set, an ID code is used in the form of a bar code or a quick response (QR) code. The set of shuffled decks of playing cards has a special card which has been packaged together with other normal cards of the shuffled decks of playing cards in one package in a factory.

6 Claims, 10 Drawing Sheets

Related U.S. Application Data continuation of application No. 14/251,336, filed on Apr. 11, 2014, now Pat. No. 9,827,484.

(56) References Cited

U.S. PATENT DOCUMENTS

| | | | | |
|---|---|---|---|---|
| 5,169,155 | A | 12/1992 | Soules et al. | |
| 5,415,414 | A | 5/1995 | Savage | |
| 5,605,334 | A | 2/1997 | McCrea, Jr. | |
| 6,217,447 | B1 * | 4/2001 | Lofink | A63F 1/18 273/292 |
| 6,698,758 | B2 | 3/2004 | Hodge | |
| 7,762,889 | B2 | 7/2010 | Shigeta | |
| 8,371,583 | B2 | 2/2013 | Shigeta | |
| 9,827,484 | B2 | 11/2017 | Shigeta | |
| 2001/0054576 | A1 * | 12/2001 | Stardust | A63F 1/14 209/939 |
| 2003/0173740 | A1 | 9/2003 | Weldon | |
| 2003/0176209 | A1 | 9/2003 | Soltys et al. | |
| 2004/0023706 | A1 | 2/2004 | Hunter et al. | |
| 2004/0026636 | A1 | 2/2004 | Shigeta | |
| 2004/0075214 | A1 | 4/2004 | Roberts | |
| 2004/0100026 | A1 | 5/2004 | Haggard | |
| 2004/0224777 | A1 | 11/2004 | Smith et al. | |
| 2005/0012270 | A1 | 1/2005 | Schubert et al. | |
| 2005/0189716 | A1 | 9/2005 | Yu | |
| 2007/0057468 | A1 | 3/2007 | Bruner | |
| 2007/0117604 | A1 * | 5/2007 | Hill | G07F 17/3258 463/16 |
| 2007/0225055 | A1 | 9/2007 | Weisman | |
| 2008/0006997 | A1 | 1/2008 | Scheper et al. | |
| 2008/0006998 | A1 | 1/2008 | Grauzer et al. | |
| 2008/0054568 | A1 | 3/2008 | Lutnick et al. | |
| 2008/0113764 | A1 | 5/2008 | Soltys | |
| 2008/0122177 | A1 | 5/2008 | Kling et al. | |
| 2008/0143048 | A1 | 6/2008 | Shigeta | |
| 2008/0207299 | A1 | 8/2008 | Whitcher | |
| 2008/0217905 | A1 * | 9/2008 | Allison | G07F 17/3227 283/56 |
| 2008/0224394 | A1 | 9/2008 | Shigeta | |
| 2008/0237987 | A1 | 10/2008 | Yoshizawa | |
| 2009/0017888 | A1 | 1/2009 | Kuhn et al. | |
| 2009/0054129 | A1 | 2/2009 | Yoshimura et al. | |
| 2009/0134575 | A1 | 5/2009 | Dickinson et al. | |
| 2009/0227311 | A1 | 9/2009 | Nakano | |
| 2009/0283971 | A1 | 11/2009 | Martineck, Sr. | |
| 2009/0286597 | A1 | 11/2009 | Shigeta | |
| 2010/0314834 | A1 | 12/2010 | Shigeta | |
| 2010/0327525 | A1 | 12/2010 | Shigeta | |
| 2011/0074107 | A1 | 3/2011 | Rowe | |
| 2012/0119441 | A1 | 5/2012 | Daines | |
| 2012/0306152 | A1 | 12/2012 | Krishnamurty et al. | |
| 2013/0026709 | A1 * | 1/2013 | Sampson | A63F 1/14 273/149 R |
| 2014/0033660 | A1 | 2/2014 | Shigeta | |
| 2014/0309006 | A1 | 10/2014 | Shigeta | |

FOREIGN PATENT DOCUMENTS

| | | | |
|---|---|---|---|
| AU | 2011303293 | A1 | 4/2013 |
| CN | 1638842 | A | 7/2005 |
| CN | 101087635 | A | 12/2007 |
| CN | 101484216 | A | 7/2009 |
| CN | 101711177 | A | 5/2010 |
| CN | 101732850 | A | 6/2010 |
| CN | 101873880 | A | 10/2010 |
| CN | 101920104 | A | 12/2010 |
| CN | 101959563 | A | 1/2011 |
| CN | 102805931 | A | 12/2012 |
| CN | 103007527 | A | 4/2013 |
| JP | 2008-104882 | A | 5/2008 |
| JP | 2008253416 | A | 10/2008 |
| JP | 2009-045466 | A | 3/2009 |
| JP | 2009213520 | A | 9/2009 |
| JP | 2011-024603 | A | 2/2011 |
| JP | 3171828 | U | 11/2011 |
| NZ | 704614 | | 8/2016 |
| WO | 2010/056562 | A1 | 5/2010 |
| WO | 2012035742 | A1 | 3/2012 |

OTHER PUBLICATIONS

CN Patent Application No. 201480020940.5, Office Action dated Jan. 7, 2019.

JP Patent Application No. 2018-079509, Office Action dated Feb. 5, 2019.

Singapore Patent Application No. 10201710608Q, Office Action dated Aug. 20, 2018.

Macau Patent Application No. I/001274, Office Action dated Feb. 27, 2018.

International Application No. PCT/JP2014/001584, International Search Report and Written Opinion dated Jun. 27, 2014.

Lucky Mojo Curio Co., "Cartomancy; Tarot Cards, Fortune Telling Cards, and Playing Cards for Divination, "Aug. 27, 2003 [retrieved from the Internet at http://www.luckymojo.com/cartomancy.html#gypsywitch on Mar. 15, 2016].

New Zealand Patent Application No. 713101, First Examination Report dated Mar. 10, 2016.

Japanese Patent Application No. 2015-550499, Office Action dated May 31, 2016.

New Zealand Patent Application No. 713101, Further Examination Report, dated Sep. 30, 2016.

GemPak; http://www.gemacocards.com/casino/wp-content/uploads/sites/2/2014/01/gempak.pdf.

Ross. David; "Dealing Them In, "Global Gaming Business Magazine, Dec. 3, 2008, vol. 7 No. 12; http://ggbmagazine.com/issue/vol_7_no_12_december_2008/article/dealing_them_in.

U.S. Appl. No. 14/251,336, Non-Final Rejection dated Oct. 29, 2015.

U.S. Appl. No. 14/251,336, Final Rejection dated Apr. 18, 2016.

U.S. Appl. No. 14/251,336, Non-Final Rejection dated Nov. 4, 2016.

U.S. Appl. No. 14/251,336, Final Rejection dated Apr. 17, 2017.

New Zealand Patent Application No. 730115, Examination Report, dated Nov. 23, 2017.

Japanese Office Action dated Jul. 26, 2022 issued in JP Application 2021-187428.

Chinese Office Action dated Jan. 18, 2023 issued in CN Application 202010555938.5.

Chinese Office Action dated Nov. 10, 2023 issued in CN Application 202010821186.2.

* cited by examiner

| | Marks | Outputs of sensors |
|---|---|---|
| 1 | Blank<br>Blank | 320 OFF<br>321 OFF |
| 2 | Blank<br>Mark | 320 OFF<br>321 ON OFF |
| 3 | Mark<br>Blank | 320 ON OFF<br>321 OFF |
| 4 | Mark<br>Mark | 320 ON OFF<br>321 ON OFF |

FIG.9

CARD GAME SYSTEM AND METHOD OF A TABLE GAME

CROSS REFERENCE TO RELATED APPLICATIONS

The present application is a continuation of U.S. patent application Ser. No. 15/794,452 filed Oct. 26, 2017, which is a continuation of U.S. patent application Ser. No. 14/251,336 filed Apr. 11, 2014 and issued as U.S. Pat. No. 9,827,484, which claims priority to AU Application No. 2013204282 filed Apr. 12, 2013, each of which is incorporated herein by reference.

TECHNICAL FIELD

The present invention relates to a table game system and a method for playing the Baccarat game, in which a bettor makes a wager that either a Banker hand or a Player hand will win.

Baccarat is one of the many live table games played in casinos or gaming establishments. Baccarat uses a standard deck of 52 playing cards and is usually dealt from a shoe having multiple decks that have been shuffled together prior to the beginning of play.

A multiple number of decks of standard playing cards, 52 in number, are used; typically eight decks or six decks are shuffled together preliminary and placed in a shoe from which the cards are dealt during the play of the game. Prior to the deal, each bettor can make one of three wagers: 1) that the Bank hand will win; 2) that the Player hand will win; or 3) that the Bank hand and the Player hand will tie. Wagering locations are provided on the Baccarat table layout. Whichever of the Bank hand or the Player hand is closest to a total on nine is the winner.

The General method of playing the conventional manner of play of Baccarat comprising:

a) dealing two cards comprising the Bank hand and dealing two cards comprising the Player hand, b) dealing an additional card to the Player hand and an additional card to the Bank hand if required according to the rule of play of Baccarat. When the rules of Baccarat require a third card for the player hand, the rule requests a "card for the Player." After the Player hand is completed, the Banker hand is completed in the same fashion, c) determining a winning hand and a losing hand according to the conventional manner of rule of play of Baccarat, d) paying off the bettor a predetermined amount if the bettor has wagered on the winning hand and collecting the amount wagered on the losing hand.

Winning Bank hand wagers are paid off at odds of one-to-one and the house charges a five percent (5%) commission on the amount won by the bettor. A winning Player hand wagers are paid off at odds of one-to-one and the bettor is not charged any commission on the amount of his winnings or his wager. Winning wagers on the Tie hand bet are paid off at odds of nine-to-one or eight-to-one (depending on the gaming establishment) and the bettor is not charged any commission on the amount of his winnings or his wager.

After all wagers are made, cards are dealt from a card shooter apparatus shoe by a dealer according to the Baccarat game rule to the Bank position and to the Player position on the table layout. The card shooter apparatus that is put on a game table and has a card reading function that reads the number of the card from the code printed on each card. The card shooter apparatus have a processing function of determining whether a winning hand is the Banker or the Player according to the Baccarat game rule based on information of numbers of the cards sequentially read by the card reading unit. These card shooter apparatus is disclosed in Patent Literature 1. (U.S. Pat. No. 7,762,889 (column 8. L.25-53, FIG. 1, 12).

CITATION LIST

Patent Literature 1: U.S. Pat. No. 7,762,889 (column 8. L.25-53, FIGS. 1 and 12)

SUMMARY OF INVENTION

A conventional Baccarat game there is no bigger odds than of nine-to-one winning wagers on the Tie hand. There is a need for a better to bet more higher paid off odds or additional wagering opportunities during the play.

The present invention has been made in view of the above problem, and aims to provide a table game system with which it is possible to provide a chance to bet more higher paid off odds and additional wagering opportunities during the play in a way that is not complicated rules.

Traditionally, each bettor who has made the largest wager is given honor to turn cards faces up. The present invention also provides a table game system to prevent a fraudulent act such as changing a cards during facing us in the card game.

To solve the above conventional problems, the present invention provides a card game system for playing the Baccarat game, comprising:

shuffled decks of playing cards being preliminary shuffled at random, a code being printed invisible under normal conditions on each card thereof and representing the number (rank) of a card, and a card shooter apparatus that is put on a game table and has a card reading function that reads the number of the card from the code;

the card shooter apparatus comprises:

a card reading unit that read the code representing the number of the card from the card, and a control unit having a processing function to determine win or lose of the card game based on information about the number of the cards sequentially read by the card reading unit;

wherein a special card has been packaged together with the shuffled decks of playing cards in one package in a factory and sealed, and the special card is different from other normal cards of card deck and has special invisible code being different from the codes of the other cards and the code representing that the card is the special card among shuffled decks of playing cards;

the control unit having a processing function to determining each card to be received the Banker or the Player, storing the number of the card read for the player or the banker and determining whether a winning hand of the Banker or the Player hand contains the special card, and the method has following further steps;

a) a bettor makes a wager that either a Bank hand or a Player hand will win and a side bet wager whether the winning hand contains the special card, b) determining whether a winning hand of the Banker or the Player hand contains the special card and the bettor having made the side bet wager for the winning hand, c) treating the winning hand as a special win when the winning hand of the Banker or the Player hand contains the special card and the bettor having made the side bet wager for the winning hand.

BRIEF DESCRIPTION OF DRAWINGS

FIG. 2A shows an example of a normal card 1 and FIG. 2B shows an example of a special card 1*a* as a special Ace, FIG. 2C shows another example of a special card different from any of other normal cards, FIG. 2D shows further example of a special card as cut card 1*c* according to the embodiment of the present invention.

FIG. 9 is a diagram illustrating the relation between output waves from sensors and marks with the card shoe apparatus.

DESCRIPTION OF EMBODIMENTS

Embodiment 1 of the present invention will be described with reference to the attached drawings. Embodiment 1 of the present invention provides a card game system for playing the Baccarat game. In FIG. 1, the shuffled decks of playing cards 1*s* are preliminary shuffled at random in a factory. The shuffled decks of playing cards 1*s* are made up of a predetermined number of decks, for example, in the case of eight decks of playing cards 1*s*, there are 416 cards. The shuffled decks of playing cards 1*s* are shuffled by a card shuffling device (will be shown after) in advance in order for them to be arranged in a random order, housed in one package 2 that encases the shuffled decks of playing cards 1*s*, sealed with a sealing material or a shrink packaging material, and then supplied to casinos.

Figure 1A:
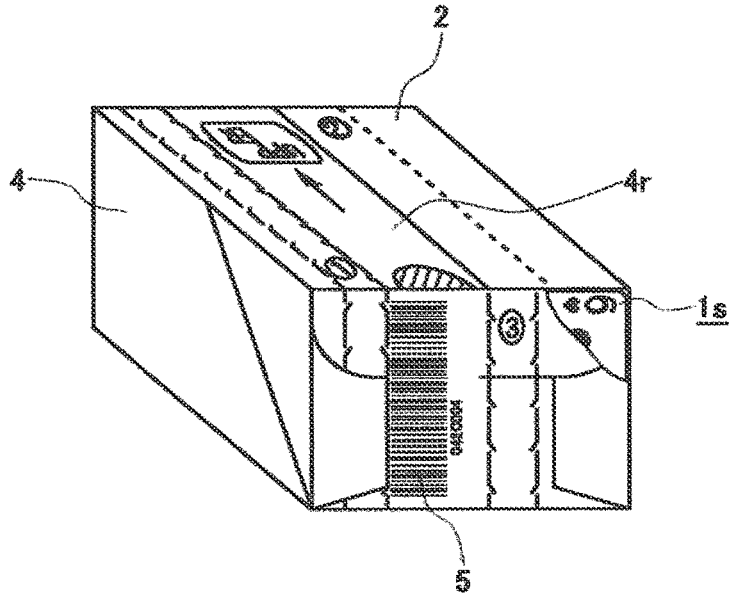
FIG. 1A is a perspective view showing a state in which a package of shuffled playing cards.
Figure 1B:
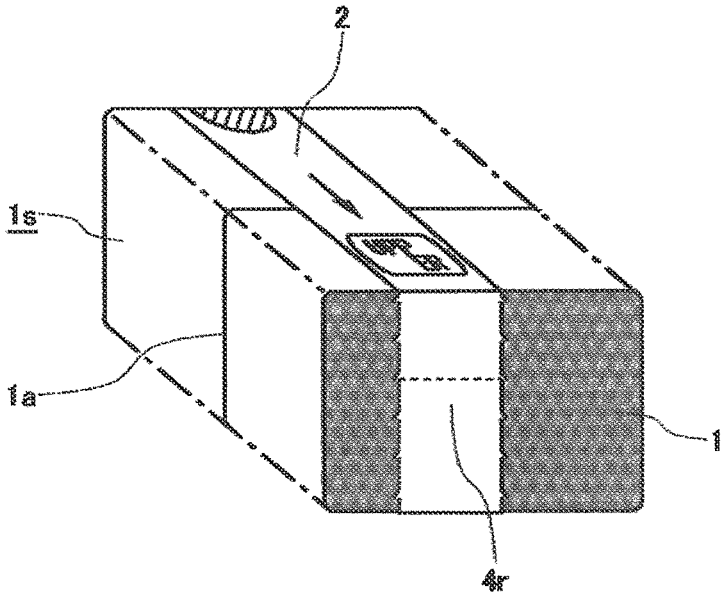
FIG. 1B is a perspective view showing a state in which a package of shuffled playing cards which is partially broken to show a portion of the cards.

Note that FIG. 1A shows a state in which the packing box 4 houses the shuffled decks of playing cards 1*s* and each being attached thereon a bar code 5, the bar codes 5 having each different ID code (identification code). The set of shuffled decks of playing cards 1*s* has a different card arrangement orders due to shuffling, and thus, each set is unique. Therefore, in order to identify each set, an ID code is used in the form of a bar code 5 or a quick response (QR) code. The set of shuffled decks of playing cards 1*s* has a special card 1*a* which has been packaged together with other normal cards 1 of the shuffled decks of playing cards 1*s* in one package in a factory (see FIG. 1B). FIG. 1B shows a state in which the packing box 4 is exposed partially and contains a special card 1*a*.

Figure 2A:
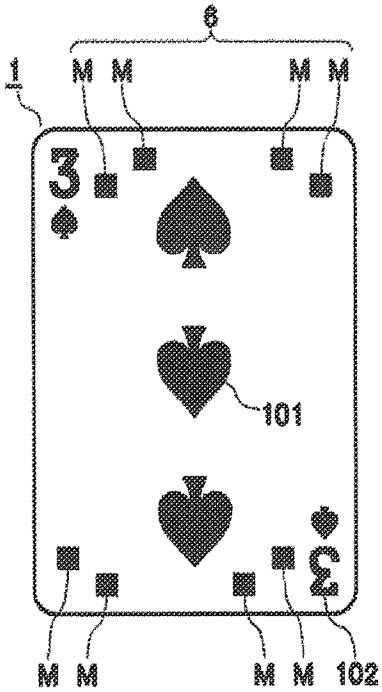
FIGS. 2A-D show an example of a card according to the embodiment of the present invention.
Figure 2B:
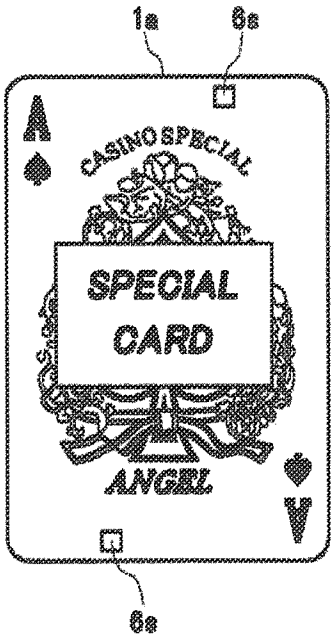
Figure 2C:
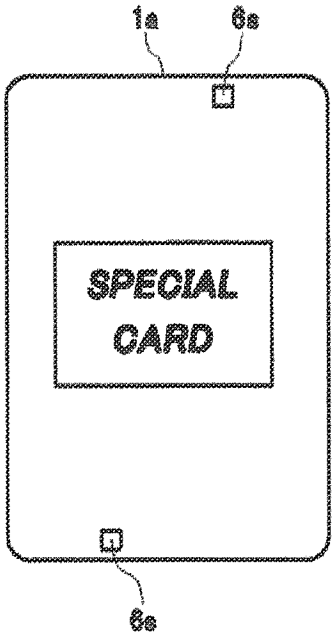
Figure 2D:
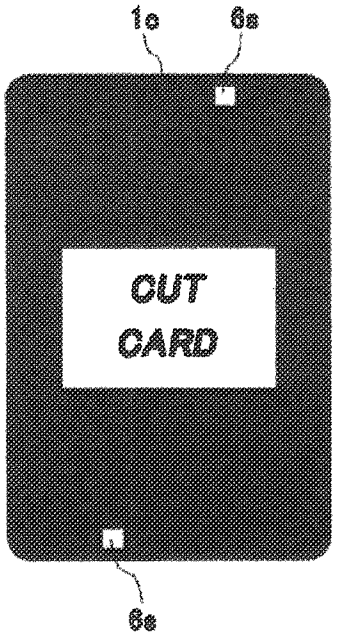

FIG. 2A shows an example of a normal card 1 and FIG. 2B shows an example of a special card 1*a* as a special Ace, FIG. 2C shows another example of a special card different from any of other normal cards, FIG. 2D shows further example of a special card as cut card 1*c* according to the embodiment of the present invention. As shown in the example of FIG. 2A, a code 6 being printed invisible under normal conditions on each card 1 thereof and representing the number (rank) of a card 1. Marks M are arranged by printing or the like so as to be invisible to the naked eye, using, for example, ultraviolet reactive ink. Marks M are arrayed on both edges of a card 1 and a code 6 is composed with the marks M suitably provided in a region where a picture or suit mark 101 is not provided as shown. The special card 1*a* is different from other normal cards 1 of a card deck and has a special code 6*s* (arrangements of invisible mark(s) M) being different from the codes 6 of the other cards 1. As described above, in the present embodiment, marks M or special code 6*s* are suitably arrayed on each edge of a card 1 or 1*a*.

As for the association between code 6 (a mark arrangement) and number of a card, a combination of two rows of mark M may be associated with the number (rank 1 to 9 and 0) of a card or each special invisible code 6*s*. Moreover, one of the rows may be associated with a number of the card and the other row may be associated with a suit of the card. In addition, FIG. 2A is just illustrative, and the number of mark rows is not limited to two, but the number of rows may be one or three or more. However, actual marks are printed using UV ink and not usually visible.

Figure 3:
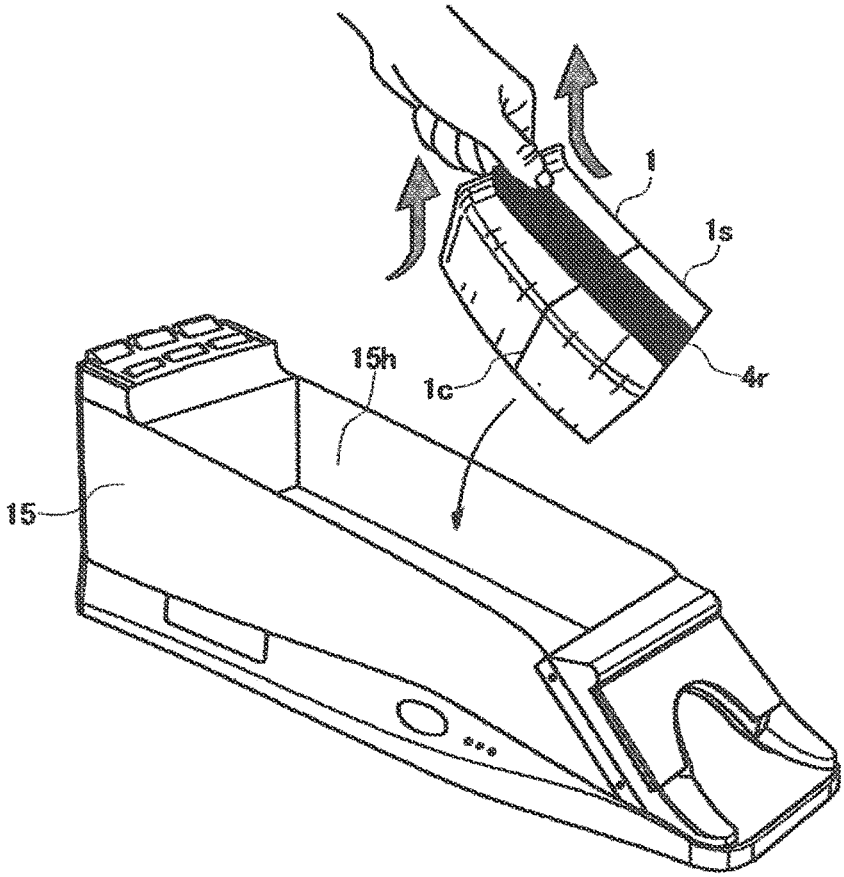
FIG. 3 is a schematic diagram showing a state in which the shuffled playing cards are housed in a card shoe apparatus.

Next, with reference to FIG. 3, a method of housing the shuffled decks of playing cards 1*s* in a card shooter apparatus 15 that is used in a casino or the like will be described. When the shuffled decks of playing cards 1*s* are housed in the card shooter apparatus 15 to be used in a casino or the like, the packing box 4 is removed partially, thereafter, the shuffled decks of playing cards 1*s* are held and lifted, then housed in a card housing portion 15*h* of the card shooter apparatus 15 as shown in FIG. 3 and the rest 4*r* of the packing box 4 is removed thereafter to use the shuffled decks of playing cards 1*s* for a new card games.

Figure 4:
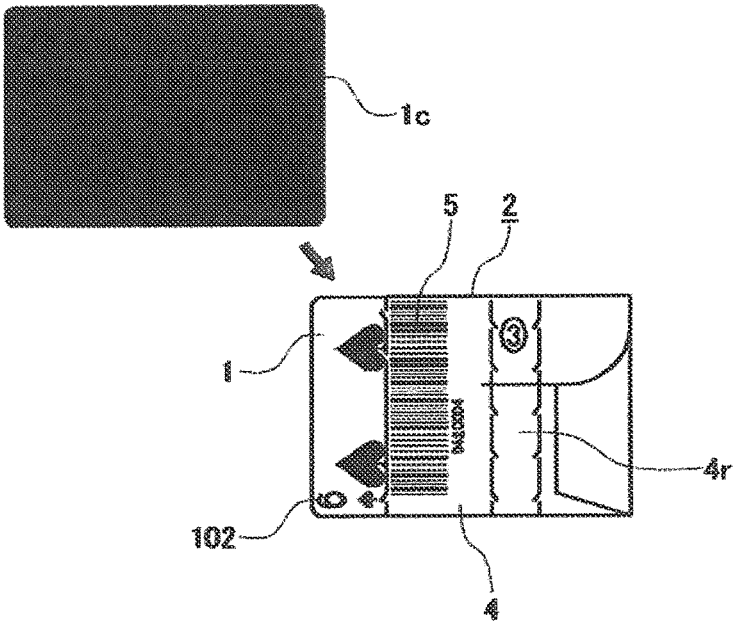
FIG. 4 is a side view showing a state in which the cut card is inserted to the shuffled playing cards.

In most casinos a card cut step of inserting a cut card 1*c* into the shuffled decks of playing cards 1*s*, which may be used in most casinos in order to stop the use of the now using shuffled decks of playing cards 1*s* in the middle of a game as appropriate as shown by FIG. 4. Customer(s) of the casino is requested to insert the cut card 1*c* into the shuffled decks of playing cards 1*s*. There may be a chance of cheating if indexes 102 of a shuffled playing card 1*s* at the place of insertion are seen when inserting the cut card 1*c*. It is important that an operator of casinos must show the backside of the shuffled decks of playing cards 1*s* not to show the index 102 of the cards. In another case, a cut card 1*c* together with the shuffled decks of playing cards 1*s* may be packaged in the packing box 4 in advance in a factory as a package 2.

Figure 5:
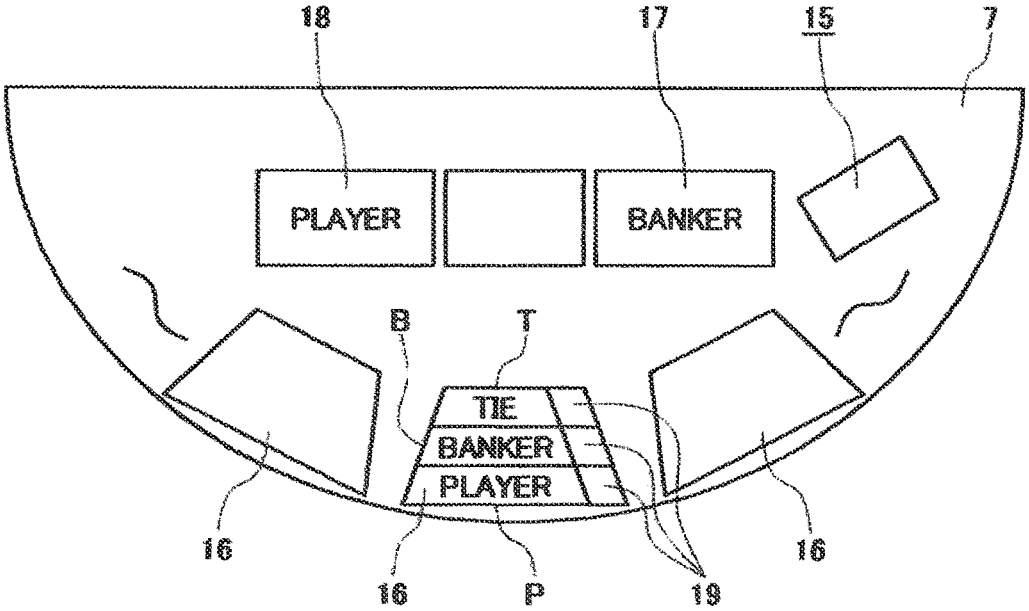
FIG. 5 is a plan view of a table used in an embodiment of the present invention.

Next, with reference to FIG. 5, a new Baccarat game using our new table game system of this invention will be described. The shuffled decks of playing cards 1*s* with special cards 1*a* (from 0 to 8 special cards are inserted in the shuffled decks of playing cards 1*s*) shown in FIGS. 2B, 2C. The card shooter apparatus 15 is used on a table 7 in a casino to deliver each card 1 on the table 7. A multiple number of decks of standard playing cards, (52 in number for 1 deck), are used; typically eight decks or six decks are shuffled together preliminary and placed in a card shooter apparatus 15 from which the cards are dealt during the play of the game. Prior to the deal, each bettor can make one of three wagers: 1) that the Bank hand will win at position B; 2) that the Player hand will win at position P; or 3) that the Bank hand and the Player hand will tie at the position T. Wagering locations are provided on the Baccarat table layout 16. Whichever of the Bank hand 17 or the Player hand 18 is closest to a total on nine is the winner.

The game rule for this invention has further rules for following further step that a bettor makes a wager that either a Bank hand or a Player hand will win together with a side bet wager at betting spots 19 whether the winning hand or Tie hands contain the special card 1*a*. A control apparatus of this invention has further rule (programmed) for determining whether a winning hand of the Banker or the Player hand contains the special card 1*a*. The game rule for this invention has further rules for treating the winning hand as a special win when the winning hand of the Banker or the Player hand contains the special card and the bettor having made the side bet wager for the winning hand. When the winning hand of the Banker or the Player hand contains the special card and the bettor having made the side bet wager for the winning hand will be paid off at odds of one-to-fifty (50).

Figure 6:
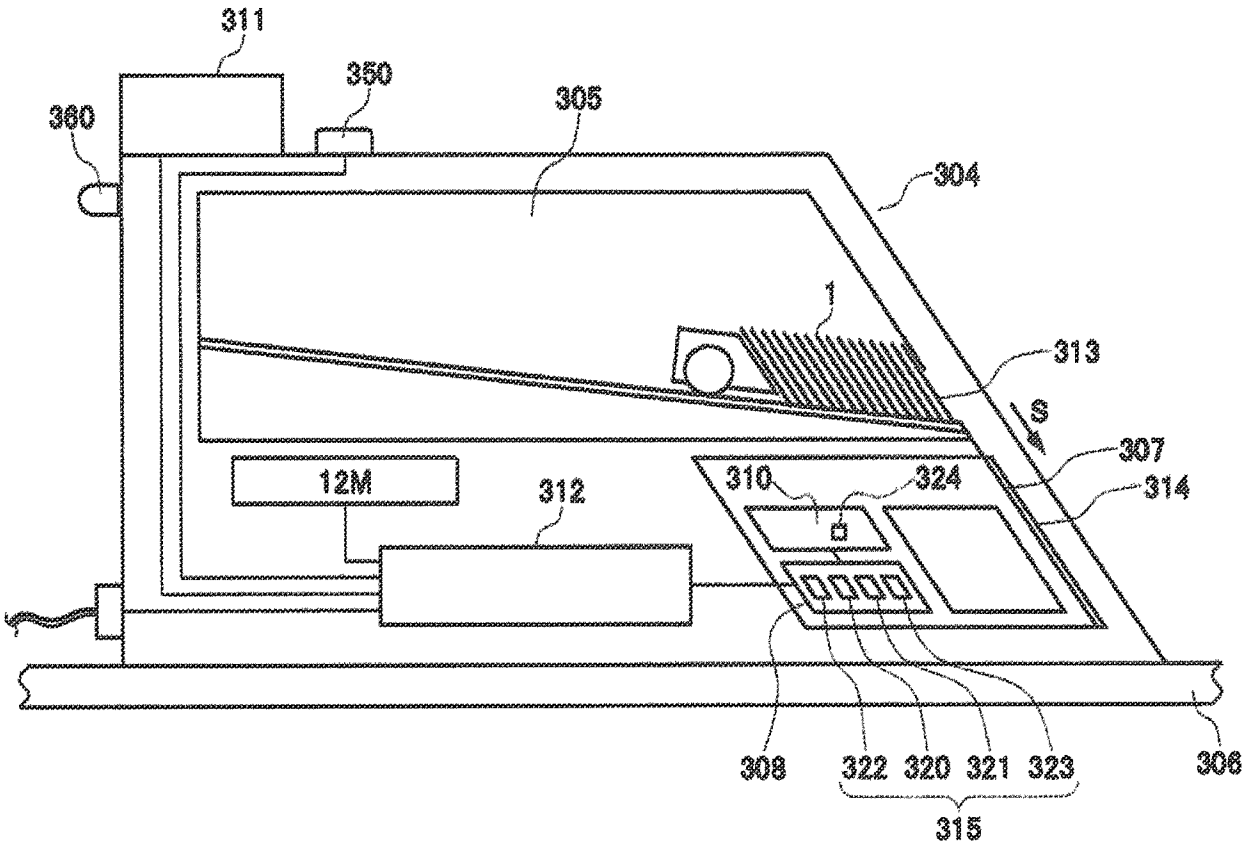
FIG. 6 is a block diagram illustrating the entirety of a card shoe apparatus of card Game system according to an embodiment of the present invention.
Figure 7:
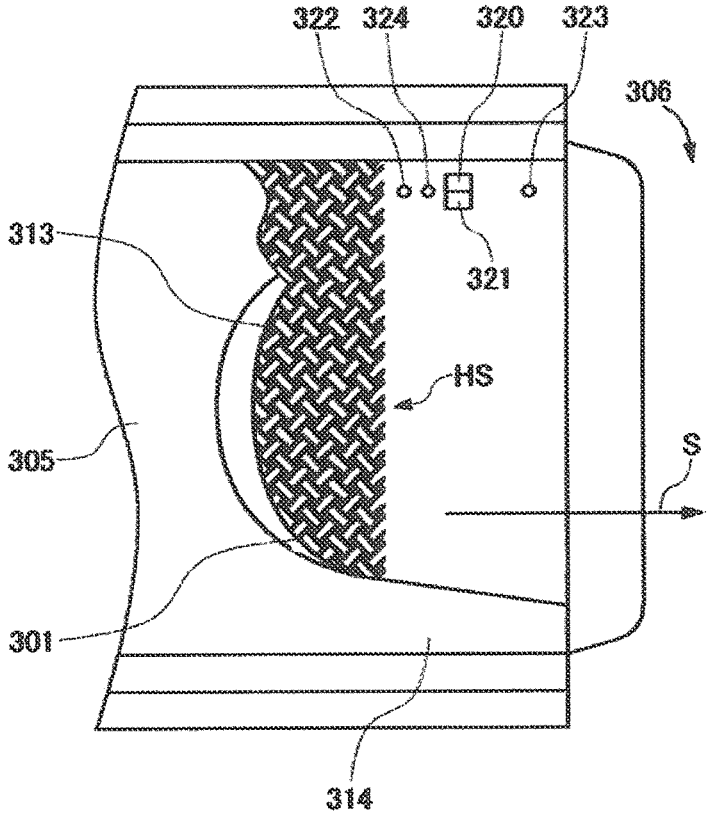
FIG. 7 is a plan view of a main portion of a card guide of the card shoe apparatus, with the card guide partially broken.
Figure 8:
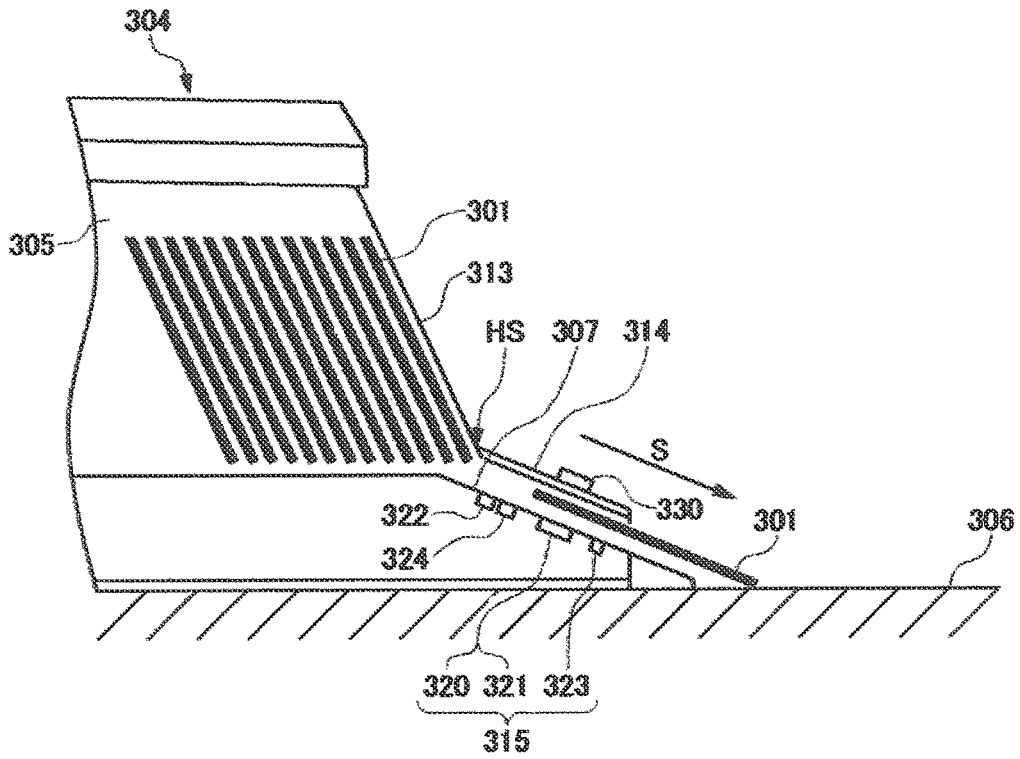
FIG. 8 is a side view of a main portion of a card guide of the card shoe apparatus, with partially broken.

An embodiment of a table game system of the present invention will be described below in detail with FIG. 6. FIG. 6 is a block diagram illustrating a card shoe apparatus, generally designated by reference number 15, for use in a table game system according to an exemplary embodiment of the present invention. The card shooter apparatus 15 includes a card guide unit 307 that guides cards 1 that are manually drawn out one by one from a card housing unit 305 onto a game table 306, a code reading unit 308 that reads, when a card 1 is manually drawn out from the card housing unit 305 by a dealer or the like of a casino, the code 6,6*s* that indicates a figure (number, rank) of that card 1 or special card, a winning/losing determination unit 310 that determines the winning/losing of the card game based on the numbers of the cards 1 sequentially read by the code reading unit 308, and an output means 311 that outputs the result of the determination made by the winning/losing determination unit 310.

Next, the code reading unit 308 that reads, from a card 1, the code 6,6*s* that indicates a figure (number, rank) of the card 1 when the card 1 is manually drawn out from the card housing unit 305 will be described in detail with reference to FIG. 5. The code reading unit 308 is provided in the card guide unit 307 that guides the cards 1 manually taken out one by one from an opening 313 onto the game table 306, with the opening 313 provided in a front portion of the card housing unit 305. The card guide unit 307 includes an inclined surface and a card guide 314 attached at an edge portion of each of both sides of the inclined surface, with the card guide 314 also serving as a sensor cover. The card guide 314 is configured to be attachable/detachable with screws or the like (not shown) so as to be replaceable. When a card guide 314 is removed, a sensor group 315 of the code reading portion 308 is exposed. The sensor group 315 is composed of four sensors, including two ultraviolet reactive sensors (UV sensors) 320 and 321, and object detection sensors 322 and 323.

The object detection sensors 322 and 323 are optical fiber sensors that each detect the presence of the card 1, and are capable of detecting movement of the card 1. The object detection sensor 322 is placed in the upstream side of the card guide unit 307 with respect to the travel direction of the card 1 (indicated by the arrow S in FIG. 6), and the object detection sensor 323 is placed in the downstream side of the card guide unit 307 with respect to the travel direction of the card 1. As shown in FIG. 6, the object detection sensors 322 and 323 are respectively provided in the upstream side and the downstream side of the UV sensors 320 and 321. The UV sensors 320 and 321 each include an LED (UV LED) that emits an ultraviolet ray and a detector. The marks M are printed on the card 1 in UV luminescent ink that emits color when UV ray is applied. The card 1 is irradiated with the UV ray (black light) or UR ray (ultra red) may be used, and the detector detects the light reflected by the marks M of the code 6,6*s* of the card 1. The UV sensors 320 and 321 are connected to a control apparatus 312 of the code reading unit 308 via a cable. In the code reading unit 308, the arrangement patterns of the marks M are determined based on the output signals from the detectors of the UV sensors 320 and 321, such that the number (rank) corresponding to the code 6,6*s* is determined.

In the code reading unit 308, the start and end of the reading performed by the UV sensors 320 and 321 are controlled by the control apparatus 312 based on the detection signals from the object detection sensors 322 and 323. Also, the control apparatus 312 determines whether the card 1 has normally passed through the card guide unit 307 based on the detection signals from the object detection sensors 322 and 323. As shown in FIG. 2A, the rectangular marks M are arranged within a framework of two rows with four columns on each of the upper and bottom edges of a card 1, and the arrangement of such marks indicates the rank (number) and the suit (Heart, Spade or the like) of the card. According to an exemplary embodiment, for each card, a mark M or code 6*s* may either be present or absent at each of the predetermined locations within the framework of rows and columns depending on the particular mark and suit to be encoded. When the UV sensor(s) 320 and/or 321 detect(s) a mark M that is filled in, such UV sensor(s) output(s) an on signal, and when the UV sensor(s) 320 and/or 321 do not detect a mark M, an on signal is not generated. In this way, the code reading unit 308 identifies the code 6 or 6*s* based on the relative difference or the like between the two marks M detected by the two UV sensors 320 and 321, thereby identifying the number (rank) and the type (suit) of the corresponding card 1 or the special card 1*a*, 1*c*.

According to an exemplary embodiment, for each card, a mark M may either be present or absent at each of the predetermined locations within the framework of rows and columns depending on the particular mark and suit to be encoded. The relation between the code 302 and the output of the on signals from the two UV sensors 320 and 321 are shown in FIG. 9. It is possible to identify a predetermined arrangement pattern of the marks M based on the comparison results of the relative changes in the output of the on signals from the UV sensors 320 and 321. As a result, in two rows (the upper and lower rows), four types of arrangement patterns of the mark M are possible, and since patterns are printed in four columns, it is possible to form 256 types of codes (4.times.4.times.4.times.4). Fifty two (52) playing cards and the special cards 1*a*, 1*c* are each assigned to one of the 256 codes, and the relations of such assignment are stored in memory 12M as an association table.

The special card 1*a* is different from other normal cards 1 of a card deck and has a special code 6*s* (arrangements of invisible mark(s) M) being different from the codes 6 of the other cards 1. As described above, in the present embodiment, the special code 6*s* is selected from 256 types of codes but different from codes of normal cards and this relations of such assignment of the special cards are also stored in memory 12M as an association table for the special cards 1*a*, 1*c*.

The special code 6*s* is also suitably arrayed on each edge of a card 1*a* and configuration thereof is thereby adopted in which the card reading unit 308 can, by identifying the code 6*s*, identify a card is the special card 1*a* based on that predetermined association table (not shown). It should be noted that the assignment of a specific code from 256 codes to each playing card or the special card 1*a* does not need to be fixed, and in other exemplary embodiments of the invention each of the 52 cards and several special cards can be freely associated with codes out of the 256 codes to be stored in the association table. Therefore, it is possible to change the associations between the 256 codes and 52 cards and the special cards would be depending on the situation or places to be used. Preferably, the code is printed with a paint material that becomes visible when irradiated with UV ray, and placed in a position where it does not overlap the indications of the card types or indexes 102.

An association table may be prepared by freely out of the 256 codes, and a plurality of different association tables (ex. 1 to 10 or more tables) may be prepared in advance. If the code 6,6*s* do not match the code defined in the applicable association table, an error is detected and it is determined that cheating may have occurred.

Next, the configuration of the control apparatus 312 will be described. The control apparatus 312, the code reading unit 308, the winning/losing determination unit 310 and the like are realized by a computer apparatus, and in particular a computer apparatus including at least a memory, at least a processor, and at least a non-transitory computer readable medium on which may be stored instructions that are read by the at least one processor to perform algorithms according to various exemplary embodiments of the present invention. The numbers of cards sequentially taken out onto the game table 306 are acquired using the UV sensors 320 and 321 in the code reading unit 308, and the numbers of cards thus acquired are sequentially stored in a memory. Conventional recognition technology that can read the number of the card directory from the surface of cards may be used to read the number of each cards.

At this time, information on which card 1 is dealt to which player is also stored (to the Bank hand 17 or the Player hand 18). The number of each card is stored in association with the player to whom that card was dealt (to the Bank hand 17 or the Player hand 18). In baccarat, there is a player and a banker. The rank (number) of the card dealt is stored in the memory in association with the Bank hand or the Player hand to whom it was dealt, and the ranks (number) of the cards dealt are added for each player (the Bank hand and the Player hand). The dealing of each card and an additional card to the Player hand and an additional card to the Bank hand are determined according to the rule of play of Baccarat stored in the control apparatus 312. When the rules of Baccarat require a third card for the player hand, the rule requests a "card for the Player." After the Player hand is completed, the Banker hand is completed in the same fashion. Then the winner is determined based on the programmed rules. A "tie" is also judged. The winning/losing determination unit 310 determines the winning/losing of the card game based on the numbers of the cards 1 sequentially read by the code reading unit 308 and whether the game of this round is over.

When the game of this round is over, an operator or dealer is required to push a result key 360 on the side of a card shoe apparatus 304 to let the output means 311 output the result, the winning/losing of each card game. The operator or dealer will pay off the bettor a predetermined amount if the bettor has wagered on the winning hand and collecting the amount wagered on the losing hand.

The game rule for this invention has further rules for following further step that a bettor makes a wager that either a Bank hand or a Player hand will win together with a side bet wager whether the winning hand contains the special card. The control apparatus 312 has further program for determining whether a winning hand of the Banker or the Player hand contains the special card and the bettor having made the side bet wager for the winning hand. The game rule for this invention has further rules for treating the winning hand as a special win when the winning hand of the Banker or the Player hand contains the special card and the bettor having made the side bet wager for the winning hand. When the winning hand of the Banker or the Player hand contains the special card and the bettor having made the side bet wager for the winning hand will be paid off at odds of one-to-fifty (50).

The control apparatus 312 has a processing function to determine win or lose of the card game based on information about the number of the cards sequentially read by the card reading unit and further has a processing function that determine each card shall be received by which hand, the Banker or the Player, and storing the number of the card read for the player and the banker. The control apparatus 312 further determines whether a winning hand of the Banker or the Player hand contains the special card, The shuffled decks of playing cards 1*s* are shuffled by a card shuffling device (as manufacturing line) as shown FIG. 10 in a random order. One or more special cards 1*a*, 1*c* also have been packaged together with the shuffled decks of playing cards by a card shuffling device (as manufacturing line) as shown FIG. 10. The number of the special card 1*a*, 1*c* to be inserted into the shuffled decks is of playing cards 1 is determined by at random number from zero (0) to ten (10) or more by a special card exchanger system 500 (a certain manipulation robot etc.). The special card exchanger system 500 is controlled by computer program and determines the number of the special cards 1*a*, 1*c* from zero to ten or more to be inserted in each the shuffled decks of playing cards 1*s*. The number of the special cards 1*a* 1*c* to be inserted differs from 0 to ten by each shuffled decks of playing cards 1*s* at random by randomizing program and according to the program the special card exchanger system 500 withdraw certain number of the normal cards (ex. Ace of spades) and insert the same number or more special cards (it may be the same suite and rank but different color of ex. Ace of spades or simply additional special cards) 1*a*, 1*c* by the predetermined number according to the random order program by the number from zero (0) to ten (10) or more.

Figure 10:
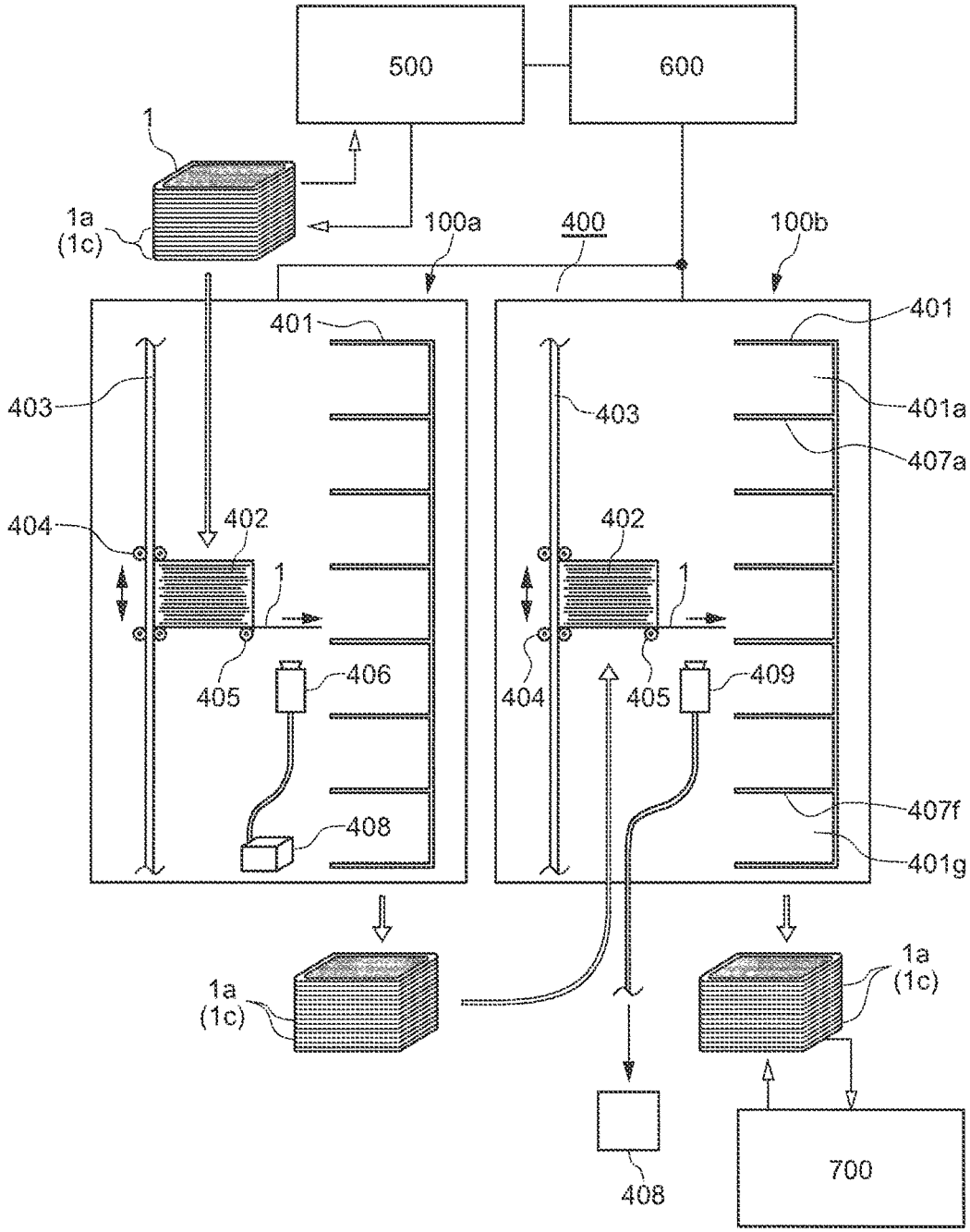
FIG. 10 is a diagram illustrating the shuffle machine to make and shuffle the shuffled playing cards of card Game system according to an embodiment of the present invention.

FIG. 10 is a diagram showing a schematic configuration of a shuffling machine 400 used to shuffle playing cards 1 together with the special cards 1*a*, 1*c* in the manufacturing process of the shuffled decks of playing cards 1*s* according to the present embodiment. As shown in FIG. 10, the shuffling machine 400 includes card stack holders 401, card feeders 402, slide rails 403, feeder travel rollers 404, a card delivery roller 405, a camera 406 (or a card sensor 409 described later), and an image processing unit 408. The card stack holder 401 has multiple pockets 401*a* to 401*g*. Incidentally, the card stack holder 401 has seven pockets, the card stack holder 401 may have any number of pockets. Movable partition plates 407*a* to 407*f* are installed between the pockets. The card feeder 402 is designed such that when all the playing cards (including several numbers of the special cards 1*a*) to be shuffled are placed on the card feeder 402, the card delivery roller 405 on the bottom rotates, sending out a card 1 from the lowermost part of the card feeder 102 toward the card stack holder 401 through a card delivery port provided in a lower flank of the card feeder 402. Also, the card feeder 402 is configured to be movable in a vertical (up and down) direction along the slide rail 403 by means of the feeder travel rollers 404 driven by drive means such as a motor (not shown).

With the configuration described above, the shuffling machine 400 alternately slides the card feeder 402 to a position facing any of the pockets 401*a* to 401*g* and sends out the card 1 from the card feeder 402 to the pocket. Incidentally, the shuffling machine 400 determines the position to move the card feeder 402 to, i.e., the position facing one of the pockets 401*a* to 401*g*, at random using a random number generator program or the like. Consequently, the cards (including several numbers of the special cards 1*a*1*a*, 1*c*) loaded in the card feeder 402 is sent out one by one in a random order to the pockets 401*a* to 401*g* of the card stack holder 401. When all the cards loaded in the card feeder 402 are sent out to the card stack holder 401, the partition plates 407*a* to 407*f* recede from the inside of the card stack holder 401 and consequently cards sorted into the pockets 401*a* to 401*g* of the card stack holder 401 are taken out of the shuffling machine 400 as a single stack. Wherein one or more special cards 1*s*, 1*c* have (has) been shuffled and will be packaged (see FIG. 1) together with the shuffled decks of playing cards in one package by the shuffling machine 400 and packaging machine (not shown) in a manufacturing factory. In this way the special card 1*a*, 1*c* that is different from other 52 normal card set of card deck 1*s* and the special card 1*s* 1*c* is shuffled at random position in the shuffled decks of playing cards 1*s* together with the other normal cards in the factory.

The receding of the pockets 401*a* to 401*g* is not absolutely necessary, and any alternative means may be used. For example, the cards may be taken out of the pockets 401*a* to 401*g* using a robot arm or the like. The manufacturing line includes multiple shuffling machines 400 configured as described above and arranged in a sequence. With two shuffling machines 400 shown as an example in FIG. 10 after going through the shuffling process, a set of playing cards (including several numbers of the special cards 1*a*, 1*c*) loaded in the card feeder 402 are shuffled. If the card feeder 402 is controlled so as to slide in a highly random manner, a set of playing cards 1 loaded in the card feeder 402 can be shuffled sufficiently randomly after the shuffling machine 400 performs the shuffling process twice. As shown by FIG. 10, multiple shuffling machines 400 performing such a shuffling process are used to perform the shuffling process in sequence, the shuffled playing cards are shuffled and ordered more randomly.

The playing cards are loaded in the card feeder 402 with the face (side on which suit and rank are printed) down (to the side of the camera 406). Each time a card 1 is sent out from the card feeder 402 to the card stack holder 401, the camera 406 shoots an image of the card 1. The resulting image is sent to the image processing unit 408. Functions of the camera 406 and image processing unit 408 vary among the shuffling machines 400 depending on the position of the shuffling machines 400 on a manufacturing line.

FIG. 10 is a schematic diagram showing part of a manufacturing line for the shuffled decks of playing cards 1*s* according to the present embodiment. The number of shuffling machines 400 is not limited to this and may be more than two. The shuffling machine 400 is configured as shown in FIG. 10, the machine 400 is equipped with a card sensor 409 instead of the camera 406. The card sensor 409 has the capability to count the number of cards passing above the sensor.

An image of a card surface shot by the camera 106 on the shuffling machine 400 is subjected to an image analysis process by the image processing unit 408 of the process control system which manages the manufacturing line including the shuffling machines 400 and consequently the suit and rank are detected on the card sent out from the card feeder 402 to the card stack holder 401. That is, on the shuffling machine 400, each time a card is sent out from the card feeder 402 to the card stack holder 401, the rank and suit on the card are detected, and when the entire set of cards (including several numbers of the special cards 1*a*, 1*c*) loaded in the card feeder 402 is sent out to the card stack holder 401, it is checked whether or not there is any excess or deficiency in the rank and suit (including several numbers of the special cards 1*a*, 1*c*) combinations contained in the set of cards (including several numbers of the special cards). For example, a set of cards made up of six decks (including several numbers of the special cards) should contain six each of identical cards and the special cards in terms of the rank and suit combination. If there is any excess or deficiency in the rank and suit combinations or several numbers of the special cards, the set of cards is discarded as a defective item. In addition to the rank and suit checking, the image processing unit 408 inspects each card for any smudge and inspects a pattern of a back design and the like as well as inspects whether or not the cards have been properly shuffled and whether or not each card complies with predetermined standards or predetermined special cards. Any set of cards containing defects is discarded.

Being installed on the shuffling machine 400 which performs the shuffling process the second time, the card sensor 409 counts the number of cards passing above the card sensor 409. In this way, the shuffling machine 400 checks the number of cards in the set of cards and several numbers of the special cards to be shuffled and thereby inspects the final product for excess or deficiency of cards. On the shuffling machine 400 which performs the shuffling process the first time, preferably both sides of the card is inspected simultaneously by installing a mirror (not shown in FIG. 10) so that the back side (patterned side) of the card will face the camera 406 or by installing another camera (not shown) which will photograph the back side of the card.

When the shuffling machine 400 which performs the final shuffling process finishes shuffling, the shuffling machine 400 outputs a shuffle-complete signal. Upon detection of the shuffle-complete signal, the process control system 408 generates a shuffled card ID (5) to be assigned to the set of shuffled playing cards 1*s* completed through the final shuffling process. The shuffled card ID is generated as a unique ID for each shuffled decks of playing cards 1*s*. The process control system associates the generated shuffled card ID with predetermined information out of production information stored in the database of the process control system 408. Any desired type and volume of such information may be used, but information which identifies the manufacturing line or shuffling machines involved in the shuffling process is particularly important.

Upon generation of a shuffled card ID, the process control system 408 registers the generated shuffled card ID in the database by associating the shuffled card ID with the manufacturing line ID of the manufacturing line involved in the manufacture of the shuffled playing cards. However, IDs are not limited to such manufacturing line-related IDs. Alternatively, a shuffling machine ID may be assigned to each shuffling machine in advance and the shuffled card ID may be registered in the database by being associated with all the shuffling machine IDs involved in the shuffling process. Incidentally, the database may be provided either in or outside the process control system.

The generated shuffled card ID is printed on the adhesive label as a bar code by a printing machine and the bar code 5 of the shuffled card ID is attached to the packing box 4 as shown in FIG. 1A. The preferred embodiment of the invention has been described hitherto. However, it is natural that the invention is not limited to the above-described embodiment, but persons skilled in the art can alter the above-described embodiment within the scope of the invention.

The special card 1*a*, 1*c* is (are) shuffled at random position in the shuffled decks of playing cards together with the other normal cards 1 in the factory, wherein the number and sorts or types of the special card 1*a* or 1*c* to be included in the shuffled decks of playing cards 1 are determined by a control system 600 of the shuffling machine 400. The number and sorts or types of the special card 1*a* or 1*c* to be included in the shuffled decks of playing cards 1 are determined at random number from 0 to ten by the control system 600. The special card 1*a* or 1*c* may be shuffled at random position together with the other normal cards 1 in the factory.

The other special card exchanger system 700 (a certain manipulation robot etc.) may be used wherein the positions of the special card to be included in the shuffled decks of playing cards is(are) determined and inserted by the special card exchanger system 700 to the shuffled decks of playing cards at random after going through the shuffling process (after the shuffling machine 400 performs the shuffling process twice or multiple shuffling machines 400) in the factory.

The positions of the special card 1*a*, 1*c* to be included in the shuffled decks of playing cards may be inserted by the other special card exchanger system 700 at the last position or the first position of the other normal cards in the factory. The special card as cut card 1*c* may be inserted at random position between the last position to several to 50 sheets from the last but at random the other special card exchanger system 700.

Annex 1:

A card game system for playing the Baccarat game, in which a bettor makes a wager that either a Banker hand or a Player hand will win, comprising:

shuffled decks of playing cards being preliminary shuffled at random, a code being printed invisible under normal conditions on each card thereof and representing the number (rank) of a card, and a card shooter apparatus that is put on a game table and has a card reading function that reads the number of the card from the code;

the card shooter apparatus comprises:

a card reading unit that reads the code representing the number of the card, and a control unit having a processing function of determining whether a winning hand is the Banker or the Player according to the Baccarat game rule based on information of numbers of the cards sequentially read by the card reading unit;

wherein a special card has been packaged together with the shuffled decks of playing cards in one package in a factory and sealed, and the special card is different from other normal cards of card deck and has special invisible code being different from the codes of the other cards and the code representing that the card is the special card;

the improvement comprising:

the card reading unit has a reading function to read the code of the special card and the control unit having a processing function to determining each card is to be received by the Banker or by the Player, storing the number of the card read for the player or the banker and determining whether a winning hand is a special win which contains the special card in the winning hand or not, wherein, the card shooter apparatus has special-win output means which outputs the winning hand of the Banker or the Player and the special win of the winning.

Annex 2:

The card game system wherein the special card is one of the Ace of spade which has a different color or shape of Ace from other Aces of spade in the decks. The card game system wherein the special card is not any one of 52 standard playing cards of a deck and has no value or number of the card. The card game system, wherein the package of the shuffled decks of playing cards contains (1-8) one to eight special cards.

Annex 3:

An improved method of playing the Baccarat game, in which a bettor makes a wager that either a Banker hand or a Player hand will win, using:

shuffled decks of playing cards being preliminary shuffled at random, a code being printed invisible under normal conditions on each card thereof and representing the number (rank) of a card, and a card shooter apparatus that is put on a game table and has a card reading function that reads the number of the card from the code;

the method comprises:

a reading step of the code representing the number of the card, and determining step whether a winning hand is the Banker or the Player according to the Baccarat game rule based on information of numbers of the cards sequentially read by the card reading unit;

wherein a special card has been packaged together with the shuffled decks of playing cards in one package in a factory and sealed, and the special card is different from other normal cards of card deck and has special invisible code being different from the codes of the other cards and the code representing that the card is the special card;

the control unit processing to determining each card to be received the Banker or the Player, storing the number of the card read for the player or the banker and determining whether a winning hand of the Banker or the Player hand contains the special card or not, and the method has following further steps;

a) a bettor makes a wager that either a Bank hand or a Player hand will win and a side bet wager whether the winning hand contains the special card, b) determining whether a winning hand of the Banker or the Player hand contains the special card and the bettor having made the side bet wager for the winning hand, c) treating the winning hand as a special win when the winning hand of the Banker or the Player hand contains the special card and the bettor having made the side bet wager for the winning hand.

Annex 4:

The method of playing the Baccarat game wherein the special card is one of the Ace of spade which has a different color or shape than other Aces of spade of the decks. The method of playing the Baccarat game wherein the special card is not any one of 52 standard playing cards of a deck and has no value or number of the card. The method of playing the Baccarat game wherein the package of the shuffled decks of playing cards contains (1-8) one to eight special cards.

What is claimed:

1. A stack of shuffled decks of playing cards comprising:

a plurality of randomly shuffled playing cards, each playing card of the plurality of randomly shuffled playing cards having printed thereon a code representing a rank of the playing card; and one or more special cards different in design from the plurality of randomly shuffled playing cards, each special card of the one or more special cards having printed thereon a special code, the one or more special cards being shuffled into a random position within the plurality of randomly shuffled playing cards or inserted into the plurality of randomly shuffled playing cards after the plurality of randomly shuffled playing cards have gone through a shuffling process, and wherein the one or more special cards and the plurality of randomly shuffled playing cards are packaged together in one package in a factory and sealed, and the special code of each special card of the one or more special cards further indicates that the special card is a cut card indicating to stop use of the stack of shuffled decks of playing cards being currently used.

2. The stack of shuffled decks of playing cards according to claim 1, wherein the special card is a cut card for indication to use a new set of shuffled decks of playing cards.

3. The stack of shuffled decks of playing cards according to claim 1, wherein the special card is a special chance or bonus card for an exceptional award to a winner of a game.

4. The stack of shuffled decks of playing cards according to claim 1, wherein the rank of the special card to be inserted into the shuffled decks of playing cards is determined by a random number from 0 to ten.

5. The stack of shuffled decks of playing cards according to claim 1, wherein the package of the stack of shuffled decks of playing cards includes a cut card on an upper side or a lower side of the shuffled decks of playing cards.

6. The stack of shuffled decks of playing cards according to claim 1, wherein the package of shuffled decks of playing cards includes a cut card in between 100 cards from the end for the shuffled decks of playing cards.

* * * * *